US007681504B2

(12) United States Patent
Machina et al.

(10) Patent No.: US 7,681,504 B2
(45) Date of Patent: Mar. 23, 2010

(54) METHOD AND APPARATUS FOR DISPLACING MATERIAL AND PROJECTILE THEREOF

(75) Inventors: Mark H. Machina, Alexandria, VA (US); Kenneth W. Mitchell, Fredericksburg, VA (US); Floyd P. Swiggett, Fredericksburg, VA (US); Michael D. Burke, Vienna, VA (US)

(73) Assignee: BAE Systems Information And Electronic Systems Integration Inc., Nashua, NH (US)

( * ) Notice: Subject to any disclaimer, the term of this patent is extended or adjusted under 35 U.S.C. 154(b) by 894 days.

(21) Appl. No.: 10/648,847

(22) Filed: Aug. 26, 2003

(65) Prior Publication Data

US 2005/0188889 A1 Sep. 1, 2005

(51) Int. Cl.
*F42B 12/22* (2006.01)

(52) U.S. Cl. ..... 102/506; 102/501; 102/520; 102/524

(58) Field of Classification Search ..... 102/506, 102/501, 520, 524
See application file for complete search history.

(56) References Cited

U.S. PATENT DOCUMENTS

| | | | | | |
|---|---|---|---|---|---|
| 2,044,819 | A * | 6/1936 | Taylor | ..... | 102/388 |
| 4,301,733 | A * | 11/1981 | Arciniega Blanco | ..... | 102/517 |
| 4,682,546 | A * | 7/1987 | Chovich | ..... | 102/529 |
| 4,977,834 | A * | 12/1990 | Denis | ..... | 102/439 |
| 5,139,216 | A * | 8/1992 | Larkin | ..... | 244/3.21 |
| 5,160,805 | A * | 11/1992 | Winter | ..... | 102/518 |
| 5,452,864 | A * | 9/1995 | Alford et al. | ..... | 244/3.23 |
| 6,405,628 | B1 | 6/2002 | Goldstein | | |
| 6,776,101 | B1 * | 8/2004 | Pickard | ..... | 102/509 |

* cited by examiner

*Primary Examiner*—Michelle Clement
(74) *Attorney, Agent, or Firm*—Rossi, Kimms & McDowell; Marc A. Rossi

(57) ABSTRACT

Hard material can be displaced by firing a frangible projectile from a firing device. The projectile has a rear portion that engages the bore of the barrel of the firing device and a front portion that is rotatably journaled to the rear portion. The front portion can be frangible to allow maximum displacement of the hard material. Specifically, the front portion has a core and a plurality of fins extending from the core. At impact, as the fins penetrate the target, the fins separate from the core and spread radially outwardly from the core.

17 Claims, 3 Drawing Sheets

METHOD AND APPARATUS FOR DISPLACING MATERIAL AND PROJECTILE THEREOF

BACKGROUND

The present invention relates to a method and apparatus for displacing material. More specifically, the invention relates to a method and apparatus for displacing material that utilizes a projectile that penetrates the material.

Conventional excavation techniques for removing materials or material build up, such as rock, concrete, such as found in buildings and reinforcements, deploy drills and explosives placed in drilled holes. Explosives when detonated cause a layer of the material to fracture and break apart. The resulting rubble is cleared from the excavation site and the process is repeated for a subsequent layer of material to be penetrated. Such conventional excavation techniques are slow and tedious in that several distinct and separate steps must be performed in sequence to excavate each layer of material to be removed. Moreover, mechanical drill bits wear down and break, with the required maintenance of mechanical drilling apparatus generally increasing in proportion to the hardness of the material to be drilled, causing delays and interruptions in the drilling process.

In this regard, U.S. Pat. No. 6,405,628 discloses a method and an apparatus for rapidly boring through and excavating hard materials and removal thereof without requiring the separate steps of drilling, placement of explosives, detonation of explosives, and debris removal associated with conventional excavation techniques. The disclosed method and apparatus involves the use of firing barrels to fire projectiles and an energetic slurry at the material to be excavated. While the technique disclosed in the patent is designed to provide a rapid removal of hard materials, nonetheless, the reloading of projectile and energetic slurry can slow the excavation progress, as the technique involves non-conventional gun technology.

It is known that conventional gun systems can also be utilized to break down materials by firing multiple projectiles at the material. Conventional gun systems, however, generally employ the use of rifling to improve the accuracy of the gun system. As is commonly known, the rifling of a barrel causes a projectile to spin, thereby imparting stability to the projectile. It has been found, however, that a spinning projectile does not penetrate a hard surface as well as a non-spinning projectile, particularly for those projectiles specifically designed for excavation work.

In view of the above, it would be desirable to provide a method and apparatus for rapidly removing or displacing material that could utilize conventional gun systems.

SUMMARY OF THE INVENTION

The present invention relates to a method and an apparatus for displacing materials, and a projectile used for the same. In particular, the present invention relates to penetrating a hard material utilizing a projectile fired from a conventional firing device, such as a gun or canon.

One aspect of the present invention is a projectile for firing from a firing device. The projectile can include a first or front portion and a second or rear portion extending from the first or front portion. The first/front and second/rear portions can be rotatably joined or formed of one piece. At least one of the first/front and second/rear portions can be configured to engage a bore of the firing device. The second/rear portion can have less mass than the first portion and a bore engaging portion.

According to another aspect of the present invention, the first/front portion can be frangible. The first/front portion comprises a core and a plurality of fins extending outwardly from the core. The fins are frangible; they are adapted to break and spread radially outwardly from the core as the first/front portion penetrates the material. The leading portion of the fins can be sloped at an angle.

Another aspect of the present invention is an apparatus for displacing material from a target, having a firing device for firing a projectile, and a cartridge adapted for chambering in the firing device. The cartridge carries the above described projectile.

Another aspect of the present invention is a method of displacing material from a target. The method includes providing the firing device, loading the cartridge carrying the projectile, and firing the above described projectile into the target to displace the material.

BRIEF DESCRIPTION OF THE DRAWINGS

The invention will be described in greater detail with reference to certain preferred embodiments thereof and the accompanying drawings, wherein.

DETAILED DESCRIPTION

Figure 1:
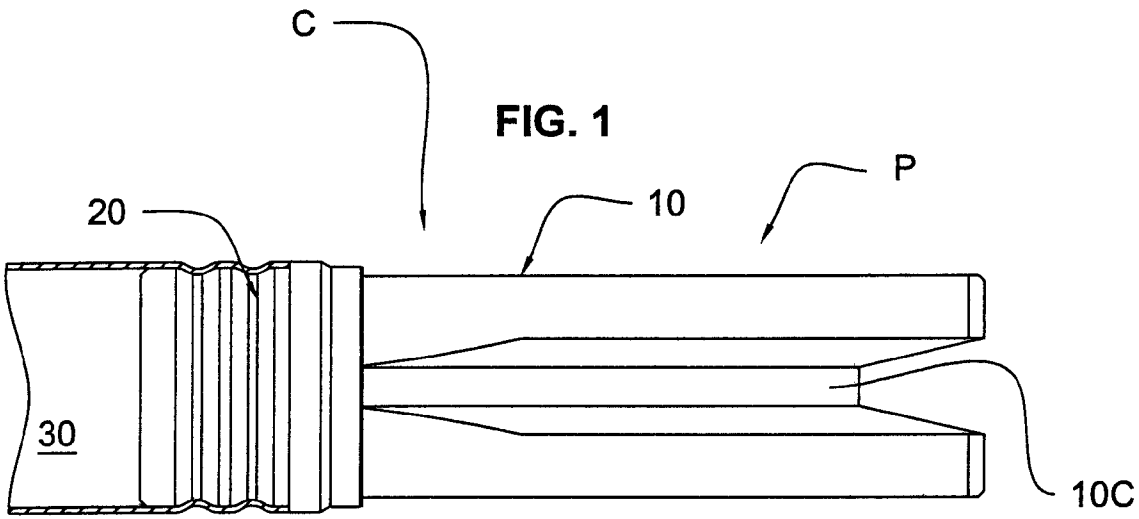
FIG. 1 illustrates a partial view of a cartridge with a projectile according to the present invention.
Figure 9:
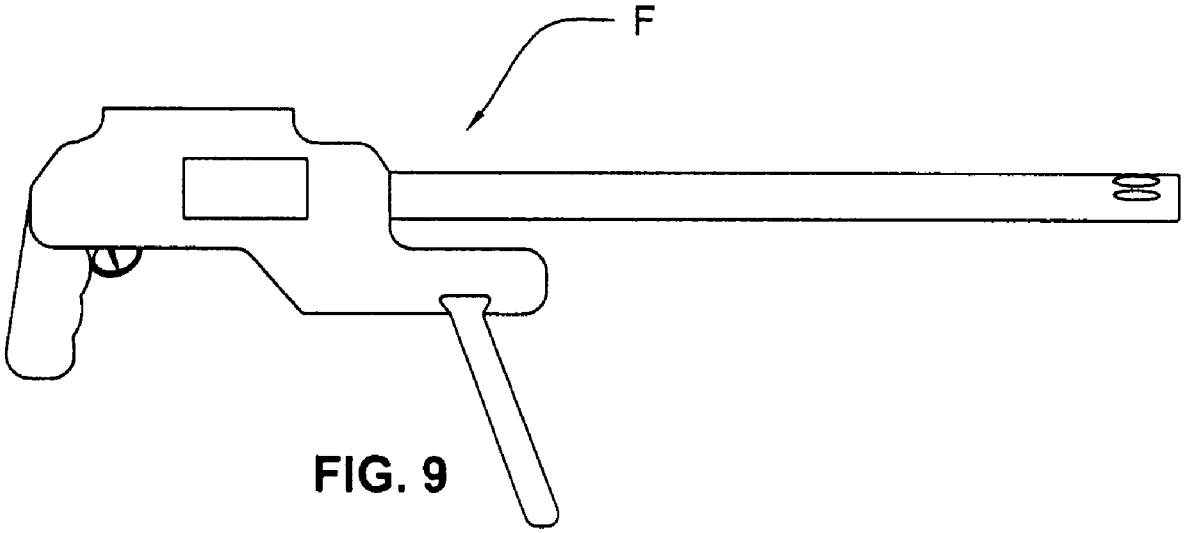
FIG. 9 illustrates schematic view of a conventional firing device, i.e., cannon or gun, for firing the projectile.

FIG. 1 illustrates a partial cross-sectional view of a cartridge C with a projectile P according to the present invention. The projectile P is the portion that is propelled from a bore or barrel of a firing device F (shown in FIG. 9) toward a target. To rapidly load the projectile into the firing device, the projectile is typically assembled into a cartridge C, which comprises the projectile P, a casing 30, a primer (not illustrated), and combustible propellant (not illustrated). The projectile P, which can come in a variety of shapes and weights to affect the trajectory and the impact to the target, is partially inserted and seated in the open mouth of the casing 30. The casing 30 holds the primer, which is seated in the base of the casing opposite to the open mouth side, and the combustible propellant is situated between the primer and the projectile. Striking the primer (typically with a firing pin) ignites the propellant, which instantaneously turns to gas to generate pressure sufficient to propel the projectile out of the firing device at a high velocity. The speed at which the projectile exits the firing device depends on the weight of the projectile and the type and amount of propellant used.

The present invention is directed to the projectile in itself, and the method and apparatus for removing or displacing material (namely hard material) using the projectile fired from a conventional firing device. In this regard, the present apparatus comprises a generic firing device F and a cartridge C that holds the projectile P. The projectile P can be loaded into a conventional cartridge that can be fired from any conventional firing device, including both the smooth bore barrel and the rifled barrel.

If the present projectile P is fired through a smooth bore, then the present projectile P can be made of a single piece. But it is desirable for the projectile P to be made of at least two components to allow the bore engaging portion to rotate relative to the penetrating front portion thereof, which allows the projectile to be fired from either the smooth bore or rifled barrel. When a projectile is fired from a rifled barrel, a portion of the projectile grips the rifling, which is specifically designed to spin the projectile, and imparts a large amount of spin. The rate of spin depends on the degree or rate (a full spin/distance traveled through the barrel) of the rifling. The present inventors have discovered that, for maximum displacement of the target material, it is desirable to propel the projectile through the target without imparting spin or minimizing the spin imparted to the projectile. Specifically, for certain types of projectiles, in particular the one shown in FIGS. 1 and 2, which is designed for maximizing the amount of displacement of the target material rather than achieving deep penetration, the projectile performance at impact can be enhanced by slowing or retarding the rotational velocity of at least the front portion of it that initially penetrates the target. This can be achieved in a variety of ways. The embodiment of illustrated in FIG. 2 merely one example.

Figure 2:
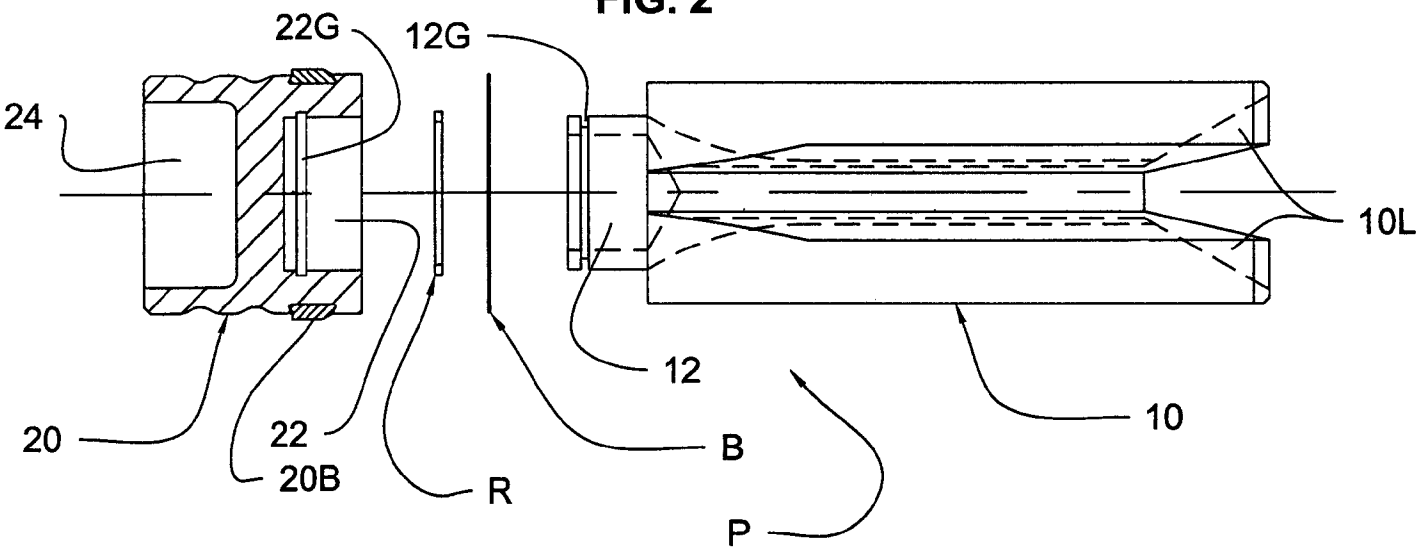
FIG. 2 illustrates an exploded, partially cross-sectional view of FIG. 1.

Referring to FIG. 2, to retard the projectile P from spinning, the projectile P can comprise a front portion 10 and a rear portion 20 that are rotatably journaled to each other. Specifically, it is desirable for the rear portion 20 to engage the rifling (when firing through a rifled barrel) so that it spins relative to the front portion 10. To impart the rear portion 20 to spin, as opposed to the front portion 10, it is made as light as possible, i.e., reduce the moment of inertia or mass, relative to the front portion 10. Making the front portion 10 heavier than the rear portion 20 retards the angular acceleration of the front portion 10 imparted by the rear portion 20. In other words, the momentum from the spinning lighter rear portion 20 will attempt to spin the front portion 10, but since the mass of the front portion 20 is greater, the spin imparted by the lighter rear portion 20 will be significantly reduced, depending on their mass difference and the amount of friction existing between their mating surfaces. Thus, to reduce the amount of spin the rear portion 20 imparts to the front portion 10, the mass of the front portion 10 can be increased related to the rear portion 20 and/or reduce the friction between the mating surfaces as much as possible.

In the present embodiment, the rear portion 20 is made lighter by making it substantially hollow. The rear portion 20 can be made of a lighter material, such as aluminum, than the front portion 10. Specifically, the present embodiment can use a cylindrical body with an H-shaped cross-section, as illustrated in FIG. 2. That is, the front and rear segments thereof are hollowed or cavitated; front and rear cavities 22, 24 thereof are cylindrical to distribute weight symmetrically or equally. The front portion 10 includes a cylindrical projection 12 that extends axially rearwardly and is configured to be complementary to the front cavity 22. The projection 12 is inserted into and seated in the front cavity 22. The cylindrical surfaces of the cavity 22 and the projection 12 act as bearing surfaces to allow the rear portion 20 to spin relative to the front portion 10.

To enhance the spinning ability (i.e., reduce friction of the bearing surfaces) of the rear portion 20 relative to the front portion 10, at least the bearing surfaces (cylindrical surfaces of the cavity and the projection 12) can be treated or formed of a material that enhances slippage or has lubricating properties. The bearing surfaces also can be lubricated and/or provided with a bearing insert therebetween. In the embodiment illustrated in FIG. 2, a bearing B in a form of a ring or washer or the like, is further included between the engaging surfaces of the front and rear portions 10, 20 to reduce friction and enhance the ability of the rear portion 20 to spin relative to the front portion 10.

In the embodiment illustrated in FIG. 2, a retainer R, in a form of a snap ring or the like is used to maintain the front and rear portions 10, 20 stay connected together. Although the retainer R is optional, it conveniently allows the front and rear portions to stay together during assembly of the cartridge and subsequential handling of the same. In this regard, the cylindrical projection 12 and the front cavity 22 can include a groove or channel 12G, 22G. After placing the bearing ring B on the cylindrical projection 12, the retainer R is seated in the groove 12G. The retainer R, in a form of a snap ring, has a slot that allows the same to be expanded/compressed to fit into the groove 12G and slid through the front cavity 22. When the snap ring is reaches the groove 22G, it expands outwardly to seat in the groove 22G. The grooves 12G, 22G should be configured so that the retainer is loosely maintained in its free state when it is seated in the grooves 12G, 22G to minimize any friction the retainer R imparts to either the first portion 10 or the second portion 20. As the retainer R is seated in both grooves 12G, 22G, it prevents the front and rear portions 10, 20 from separating axially, while allowing these portions to rotate relative to each other. The retainer R can be made of bearing material to reduce friction.

Still referring to FIG. 2, the rear portion 20 further includes a raised portion 20B that is configured to engage the bore/rifling. In the illustrated embodiment, the raised portion 20B is a cylindrical band or ring snuggly fit into an outer groove formed in the front part of the rear portion 20. The band 20B can be formed of relatively soft or malleable material, such as brass, that can dig into the rifling/bore and create a tight seal against the bore to prevent expanding gas from escaping. The band 20B can be formed integral with the rear portion. As explained before, the front and rear portions 10, 20 need not be made of separate components if it is to be fired through a smooth bore.

Figure 3:
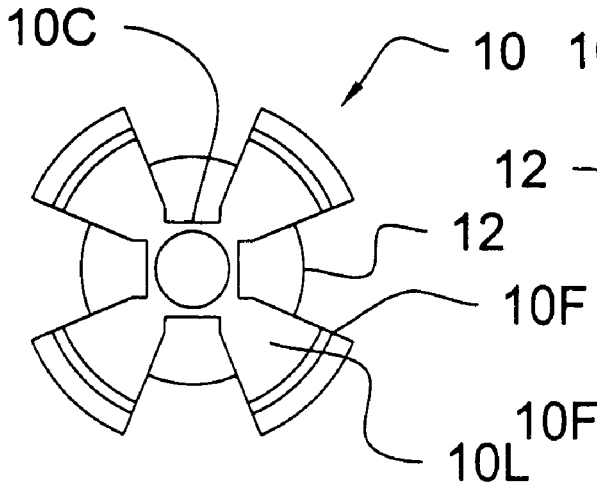
FIG. 3 illustrates a front view (right side) of a front portion of the projectile of FIG. 2.
Figure 4:
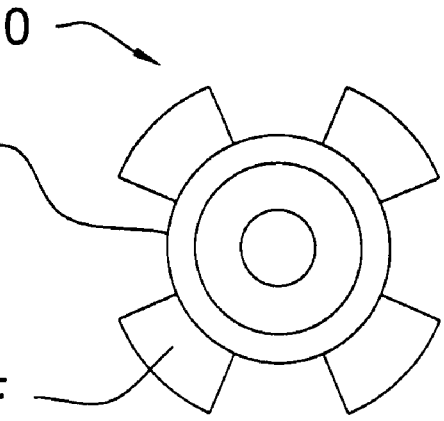
FIG. 4 illustrates a rear view (left side) view of the front portion of the projectile of FIG. 2.
Figure 5:
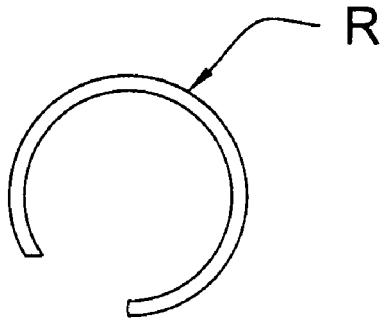
FIG. 5 illustrates a planar view of a retainer of FIG. 2.
Figure 6:
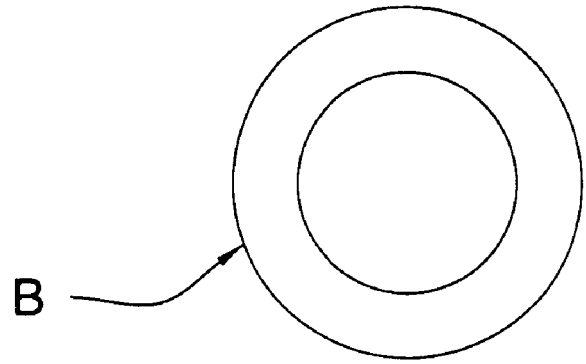
FIG. 6 illustrates a planar view of a bearing of FIG. 2.
Figure 7:
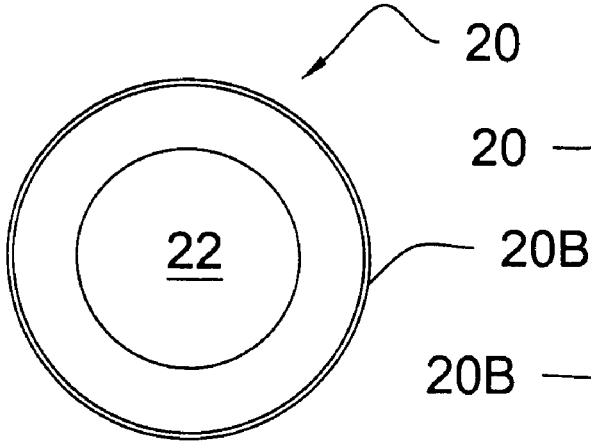
FIG. 7 illustrates a front view (right side) of a rear portion of the projectile of FIG. 2.
Figure 8:
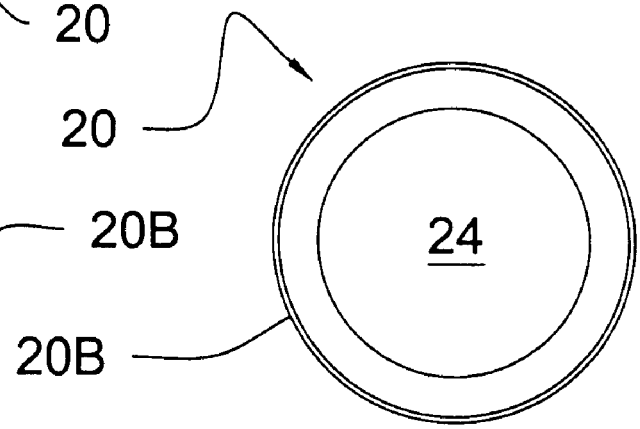
FIG. 8 illustrates a rear view (left side) of the rear portion of the projectile of FIG. 2.

The front projectile 10 can have any desirable configuration to effectuate desirable performance at impact. The embodiment of the projectile illustrated in FIGS. 2, 3, and 4, is a frangible type, one that allows portions of the front projectile to separate to maximize the amount of target material that can be removed. In this regard, the front portion 10 comprises a core 10C and a plurality of frangible fingers 10F extending radially outwardly from the core. The frangible fingers or fins 10F are configured to break and spread radially outwardly from the core as the front portion penetrates the target. Although the illustrated embodiment has four fins 10F evenly positioned around the core 10C (or spaced apart 90 degrees), it can have fewer or more fins, depending on the desired performance at impact. The core 10F can be made hollow, as better illustrated in FIGS. 2-4, to reduce the mass at the center. By placing more mass on the outer periphery of the fins 10F, the frangible performance can be enhanced, while increasing the angular momentum of inertia (at least as to countering the spinning). Moreover, the leading end 10L of the fins 10F, which leading end extending from the front most portion of the core 10C to the front most portion the fins 10F, can be angled to enhanced the ability of the fins 10F to separate and spread radially outwardly. In other words, the leading end 10L of the front projectile 10 is conically sloped. The slope can be any angle, depending on the desired performance on the target material. But the desirable angle for maximizing the removal of the target is in the range of 30-45°. As the fins separate from the core and proceed into the target at angles that depend on the slope angle of the leading end 10L and the properties of the target material. The depth of penetration and the amount of spreading of the fingers are function of the muzzle velocity and the specific design of the projectile and the material used. The front portion 10 can be formed of any strong dense or heavy material, such as 4340, 4140 steel, or alloys of steel, tungsten, drill rod, etc.

Given the disclosure of the present invention, one versed in the art would appreciate that there may be other embodiments and modifications within the scope and spirit of the present invention. Accordingly, all modifications and equivalents attainable by one versed in the art from the present disclosure within the scope and spirit of the present invention are to be included as further embodiments of the present invention. The scope of the present invention accordingly is to be defined as set forth in the appended claims.

What is claimed is:

1. A projectile for use with a firing device including either a smooth bore or a rifled bore, the projectile comprising:

a front portion; and a rear portion extending from the front portion;

wherein the front and rear portions are rotatably joined to each other to allow the front portion and the rear portion to rotate relative to each other at different rotational velocities when fired and until the projectile impacts a target;

wherein the rear portion includes a raised portion that is configured to engage a bore of a firing device when the projectile is fired in order to induce relative rotation between the front and rear portion; and wherein the raised portion is a cylindrical band.

2. A projectile according to claim 1, wherein the rear portion has less mass than the front portion.

3. A projectile according to claim 1, wherein the front portion is frangible.

4. A projectile as claimed in claim 1, wherein the front portion and the rear portion are rotatably joined with a bearing.

5. A projectile for use with a firing device including either a smooth bore or a rifled bore, comprising:

a first portion that is frangible; and a second portion extending from the first portion;

wherein the first and second portions are rotatably joined to each other to allow the first portion and the second portion to rotate relative to each other at different rotational velocities when fired and until the projectile impacts a target;

wherein at least one of the first and second portions comprises a raised portion that is configured to engage a bore of a firing device when the projectile is fired in order to induce relative rotation between the first portion and second portion;

wherein the first portion comprises a core and a plurality of fins extending outwardly from the core; and wherein the raised portion is a cylindrical band.

6. A projectile according to claim 5, wherein the fins are frangible, which are adapted to break and spread radially outwardly from the core as the first portion penetrates a target.

7. A projectile according to claim 6, wherein a leading portion of the fins is sloped at an angle.

8. A projectile as claimed in claim 5, wherein the first portion and the second portion are rotatably joined with a bearing.

9. A projectile for use with a firing device that includes either a smooth bore or a rifled bore, comprising:

a front portion; and a rear portion extending from the front portion;

wherein the front portion comprises a core and a plurality of fins extending outwardly from the core;

wherein the rear portion includes a raised portion that is configured to engage a bore of a firing device when the projectile is fired in order to induce relative rotation between the front portion and rear portion;

wherein the front and rear portions are rotatably joined to each other to allow the first portion and the second portion to rotate relative to each other at different rotational velocities when fired and until the projectile impacts a target; and wherein the raised portion is a cylindrical band.

10. A projectile according to claim 9, wherein the fins are frangible, which are adapted to break and spread radially outwardly from the core as the first portion penetrates a target.

11. A projectile according to claim 10, wherein a leading portion of the fins is sloped at an angle.

12. A projectile according to claim 9, wherein the rear portion has less mass than the front portion.

13. A projectile as claimed in claim 9, wherein the front portion and the rear portion are rotatably joined with a bearing.

14. An apparatus for displacing material from a target, comprising:

a firing device including a firing chamber and a bore; and at least one cartridge that fits in the firing chamber of the firing device and includes a projectile;

wherein the projectile includes a front portion and a rear portion rotatably joined to each other to allow the front portion and the rear portion to rotate relative to each other at different rotational velocities when fired and until the projectile impacts a target, wherein the rear portion includes a raised portion that is configured to engage the bore of the firing device when the projectile is fired from the firing device in order to induce a relative rotation between the front portion and the rear; and wherein the raised portion is a cylindrical band.

15. An apparatus as claimed in claim 14, wherein the front portion and the rear portion are rotatably joined with a bearing.

16. An apparatus for displacing material from a target, comprising:

a firing device including a firing chamber and a bore; and at least one cartridge that fits in the firing chamber of the firing device and includes a projectile comprising a front portion and a rear portion extending from the front portion;

wherein the front portion comprises a core and a plurality of fins extending outwardly from the core, wherein the rear portion includes a raised portion that is configured to engage the bore of the firing device when the projectile is fired from the firing device in order to induce relative rotation between the front portion and the rear portion, wherein the front and rear portions are rotatably joined to each other to allow the front portion and the rear portion to rotate relative to each other at different rotational velocities when fired and until the projectile impacts a target; and wherein the raised portion is a cylindrical band.

17. An apparatus as claimed in claim 16, wherein the front portion and the rear portion are rotatably joined with a bearing.

* * * * *